US009573784B2

(12) United States Patent
Piatt et al.

(10) Patent No.: US 9,573,784 B2
(45) Date of Patent: Feb. 21, 2017

(54) TRANSPORT USING PEAKED WEB GUIDE AND ROLLER

(71) Applicant: Eastman Kodak Company, Rochester, NY (US)

(72) Inventors: Michael Joseph Piatt, Dayton, OH (US); Harsha S. Bulathsinghalage, Miamisburg, OH (US); John Leonard Hryhorenko, Webster, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 434 days.

(21) Appl. No.: 14/106,911

(22) Filed: Dec. 16, 2013

(65) Prior Publication Data

US 2015/0166290 A1 Jun. 18, 2015

(51) Int. Cl.

| | |
|---|---|
| ***B65H 23/26*** | (2006.01) |
| ***B41J 15/04*** | (2006.01) |
| ***B41J 15/16*** | (2006.01) |
| ***B65H 20/14*** | (2006.01) |
| ***B65H 23/025*** | (2006.01) |

(52) U.S. Cl.

CPC ..... *B65H 23/26* (2013.01); *B41J 15/046* (2013.01); *B41J 15/16* (2013.01); *B65H 20/14* (2013.01); *B65H 23/0251* (2013.01); *B65H 23/0258* (2013.01); *B65H 2404/1313* (2013.01); *B65H 2404/1314* (2013.01); *B65H 2601/254* (2013.01); *B65H 2801/15* (2013.01)

(58) Field of Classification Search

CPC ..... B65H 2404/1118; B65H 2404/1119; B65H 2404/1313; B65H 2404/1314;B65H 2404/1414; B65H 2404/1415; B65H 23/26; B65H 23/0258; B65H 23/0251; B41J 15/046; B41J 15/16; B41J 15/165

See application file for complete search history.

(56) References Cited

U.S. PATENT DOCUMENTS

| | | | | |
|---|---|---|---|---|
| 813,288 | A * | 2/1906 | Hancock | 162/273 |
| 3,462,093 | A | 8/1969 | Peery | |
| 5,285,726 | A | 2/1994 | Ohta | |
| 5,388,513 | A | 2/1995 | Ohta | |
| 9,216,595 | B1 * | 12/2015 | Piatt | B41J 11/0085 |
| 9,266,363 | B1 * | 2/2016 | Katerberg | B41J 11/04 |
| 9,333,769 | B1 * | 5/2016 | Katerberg | B41J 11/04 |
| 2005/0089640 | A1 * | 4/2005 | Tanaka | G11B 5/842 427/356 |

* cited by examiner

*Primary Examiner* — William E Dondero
(74) *Attorney, Agent, or Firm* — William R. Zimmerli; David A. Novais

(57) ABSTRACT

A print media moving apparatus includes a web guide positioned immediately upstream relative to a roller. The web guide has an arcuate surface including three sections with the second section located between the first and third sections. The arcuate surface includes a peak in the second section. The roller, having a diameter and rotational axis, includes three sections with the second section located between the first and third section as viewed along the rotational axis. The diameter of the roller in the first and third sections is greater than in the second section. The three sections of the web guide correspond to the three sections of the roller such that the contour of the arcuate surface causes the print media, after leaving the web guide, to contact the first and third sections of the roller prior to contacting the second section of the roller.

8 Claims, 11 Drawing Sheets

TRANSPORT USING PEAKED WEB GUIDE AND ROLLER

FIELD OF THE INVENTION

The invention relates generally to the field of digitally controlled printing systems, and more particularly to transporting a print media through a printing system.

BACKGROUND OF THE INVENTION

In a digitally controlled printing system, such as an inkjet printing system, a print media is directed through a series of components. The print media can be a cut sheet or a continuous web. A web or cut sheet transport system physically moves the print media through the printing system. As the print media moves through the printing system, liquid, for example, ink, is applied to the print media by one or more printheads through a process commonly referred to a jetting of the liquid. The jetting of liquid onto the print media introduces significant moisture content to the print media, particularly when the system is used to print multiple colors on a print media. Due to its moisture content, the print media expands and contracts in a non-isotropic manner often with significant hysteresis. The continual change of dimensional characteristics of the print media often adversely affects image quality. Although drying is used to remove moisture from the print media, drying too frequently, for example, after printing each color, also causes changes in the dimensional characteristics of the print media that often adversely affects image quality.

FIG. 1 is a schematic representation of a portion of the print media as the print media passes over two conventional rollers that support the print media under each row of printheads. During an inkjet printing process, the print media can expand as the print media absorbs the water-based inks applied to it. When the direction of expansion is in a direction that is perpendicular to the direction of media travel 100, it is often referred to as expansion in the crosstrack direction 102. Typically, the wrap of the print media around a roller of an inkjet printing system produces sufficient friction between the print media and the roller that the print media is not free to slide in the crosstrack direction even though the print media is expanding in that direction. This can result in localized buckling of the print media away from the roller to create lengthwise ripples, also called flutes or wrinkles, in the print media. Flutes or ridges 104, 106 can be produced in the print media due to expansion of the print media in the crosstrack direction 102 because the print media cannot slip on the rollers 108, 110. Flutes can become permanent creases in the paper as the print media passes over a roller if the flutes have sufficient height as the print media approaches the roller and the wrap angle of the print media is high.

As such, there is an ongoing need to provide digital printing systems and processes with the ability to effectively handle print media expansion associated with the absorption of water by the print media.

SUMMARY OF THE INVENTION

According to an aspect of the present invention, an apparatus for moving a continuous web of print media includes a web guide and a roller. The web guide has an arcuate surface including a first section, a second section, and a third section with the second section being located between the first section and the third section. The arcuate surface includes a peak located in the second section. The roller, having an axis of rotation and a diameter, includes a first section, a second section, and a third section with the second section being located between the first section and the third section as viewed along the axis of rotation. The roller includes a profile as viewed along the axis of rotation in which the diameter of the roller in the first section and the diameter of the roller in the third section are each greater than the diameter of the roller in the second section. The web guide is positioned along a media travel path immediately upstream relative to the roller with the first section, the second section, and the third section of the web guide corresponding to the first section, the second section, and the third section of the roller such that the contour of the arcuate surface causes the print media, after leaving the web guide, to contact the first section and the third section of the roller prior to contacting the second section of the roller.

In one example embodiment of the present invention, the web guide is a convex roller. In another example embodiment of the present invention, the web guide is a non-rotating web guide.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
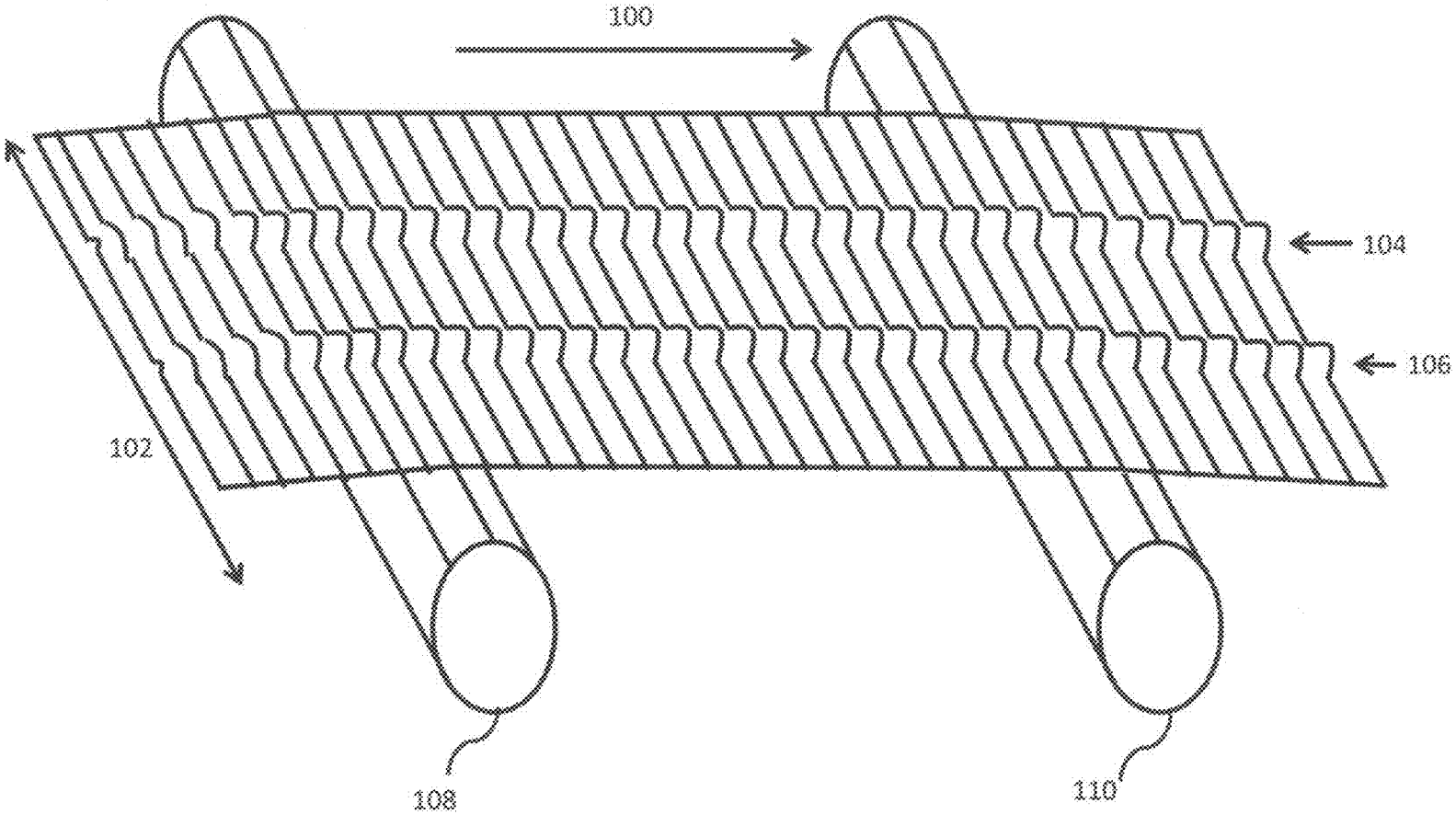
FIG. 1 (PRIOR ART)
FIG. 1 is a schematic representation of a portion of the print media as the print media passes over two conventional rollers that support the print media under each row of printheads.

The present description will be directed in particular to elements forming part of, or cooperating more directly with, a web transport system. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The example embodiments of the present invention are illustrated schematically and not to scale for the sake of clarity. One of ordinary skill in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. Such liquids include inks, both water based and solvent based, that include one or more dyes or pigments. Other non-ink liquids also include various substrate coatings and treatments, various medicinal materials, and functional materials useful for forming, for example, various circuitry components or structural components. As such, as described herein, the terms "liquid" and "Ink" refer to any material that is ejected by the printhead or printhead components described below.

Inkjet printing is commonly used for printing on paper, however, there are numerous other materials in which inkjet is appropriate. For example, vinyl sheets, plastic sheets, textiles, paperboard, and corrugated cardboard can comprise the print media. Additionally, although the term inkjet is often used to describe the printing process, the term jetting is also appropriate wherever ink or other liquid is applied in a consistent, metered fashion, particularly if the desired result is a thin layer or coating.

Inkjet printing is a non-contact application of an ink to a print media. Typically, one of two types of ink jetting mechanisms are used and are categorized by technology as either drop on demand ink jet (DOD) or continuous ink jet (CIJ). The invention described herein is applicable to both types of printing technologies. As such, the terms printhead, linehead, and nozzle array, as used herein, are intended to be generic and not specific to either technology.

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Additionally, there are typically two types of print media used with inkjet printing systems. The first type is commonly referred to as a continuous web while the second type is commonly referred to as a cut sheet(s). The continuous web of print media refers to a continuous strip of media, generally originating from a source roll. The continuous web of print media is moved relative to the inkjet printing system components via a web transport system, which typically include drive rollers, web guide rollers, and web tension sensors. Cut sheets refer to individual sheets of print media that are moved relative to the inkjet printing system components via rollers and drive wheels or via a conveyor belt system that is routed through the inkjet printing system.

Aspects of the present invention are described herein with respect to an inkjet printing system. However, the term "printing system" is intended to be generic and not specific to inkjet printing systems. The invention is applicable to other types of printing systems, such as offset or traditional printing press technologies that print on a print media as the print media passes through the printing system.

Figure 2:
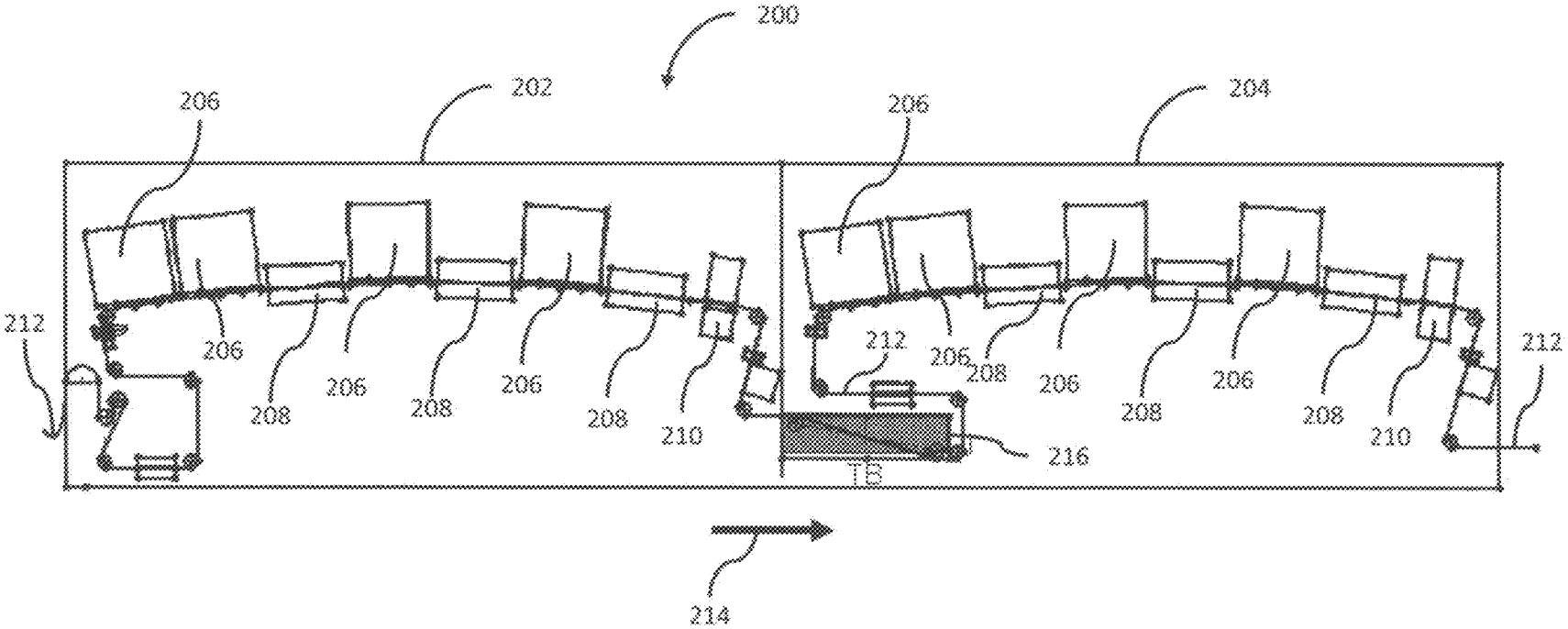
FIG. 2 is a schematic side view of a printing system for continuous web printing on a print media made in accordance with the present invention.

The terms "upstream" and "downstream" are terms of art referring to relative positions along the transport path of the print media; points on the transport path move from upstream to downstream. In FIG. 2, the print media moves in a direction indicated by feed direction arrow 214. Where they are used, terms such as "first", "second", and so on, do not necessarily denote any ordinal or priority relation, but are simply used to more clearly distinguish one element from another.

Referring now to FIG. 2, there is shown a printing system for continuous web printing on a print media. The print media is continuous as the print media passes through the printing system. The printing system 200 includes a first module 202 and a second module 204, each of which includes lineheads 206, dryers 208, and a quality control sensor 210. The lineheads 206, dryers 208, and quality control sensors 210 are positioned opposite a first side of the print media 212. In addition, the first module 202 and the second module 204 include a web tension system (not shown) that serves to physically move the print media 212 through the printing system 200 in the feed direction 214 (left to right in the figure).

The print media 212 enters the first module 202 from a source roll (not shown). The print media 212 is supported and guided through the printing system by rollers (not shown) without the need for a transport belt to guide and move the print media through the printing system. The linehead(s) 206 of the first module applies ink to the first side of the print media 212. As the print media 212 feeds into the second module 204, there is a turnover mechanism 216 which inverts the print media 212 so that linehead(s) 206 of the second module 204 can apply ink to the second side of the print media 212. The print media 212 then exits the second module 204 and is collected by a print media receiving unit (not shown).

As the print media 212 passes through the printing system, the one or more lineheads 206 selectively deposit ink on the print media in response to the image data to be printed. The water in the ink can cause the print media to expand. This can cause flutes to form in the print media as described earlier. It is desirable to suppress the flutes before the print media passes over a high wrap angle roller, such as roller following the image quality sensor 210 around which the print media takes an approximately 90° wrap.

In the printing industry, fluting is commonly reduced by means of spreaders which produce tension to the print media in the crosstrack direction to stretch or spread the print media in the cross track direction. A well known type of spreader is a concave roller that rotates around an axis of rotation.

Figure 3:
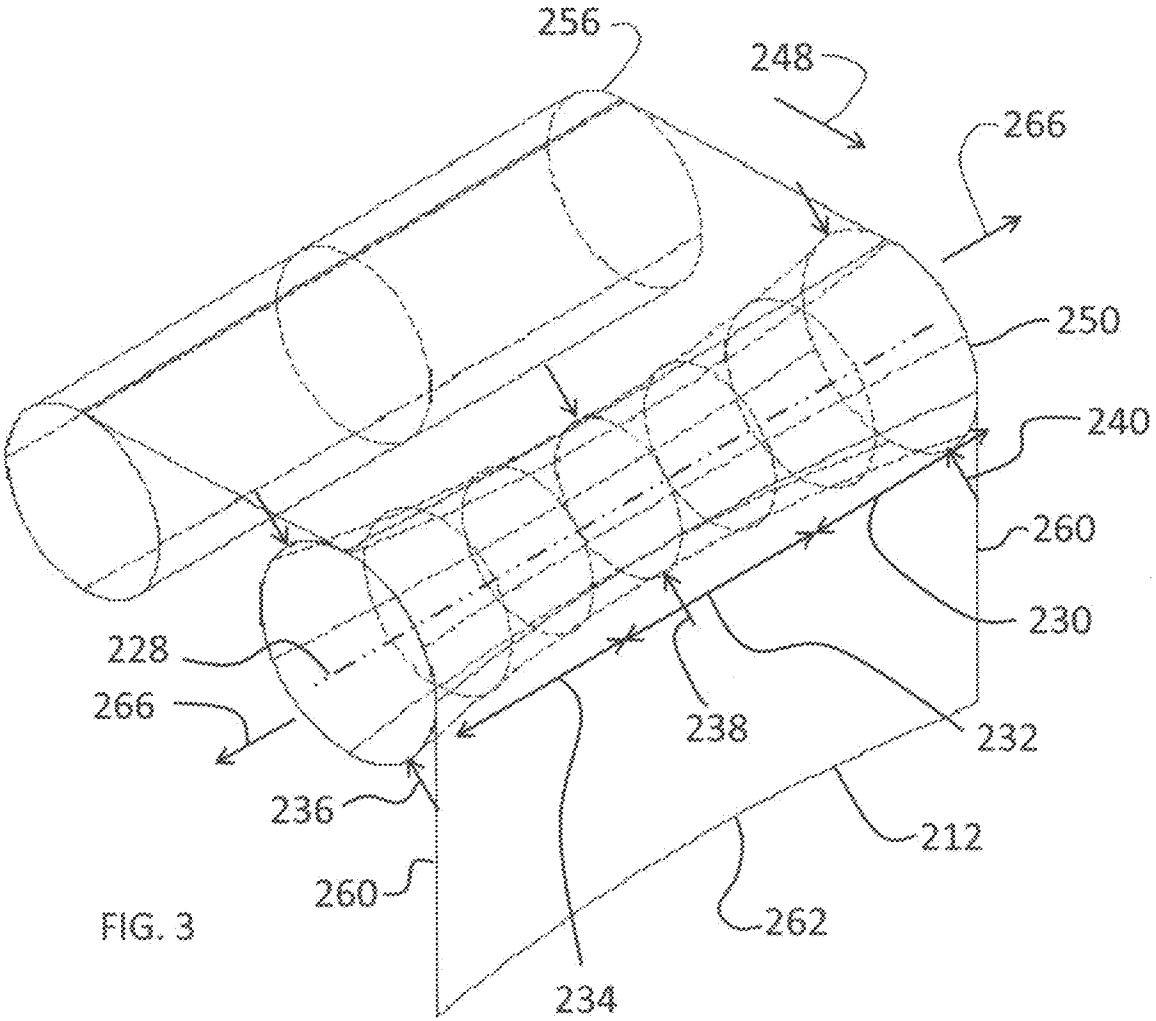
FIG. 3 is a schematic perspective view of a portion of an example embodiment of the present invention.
Figure 4:
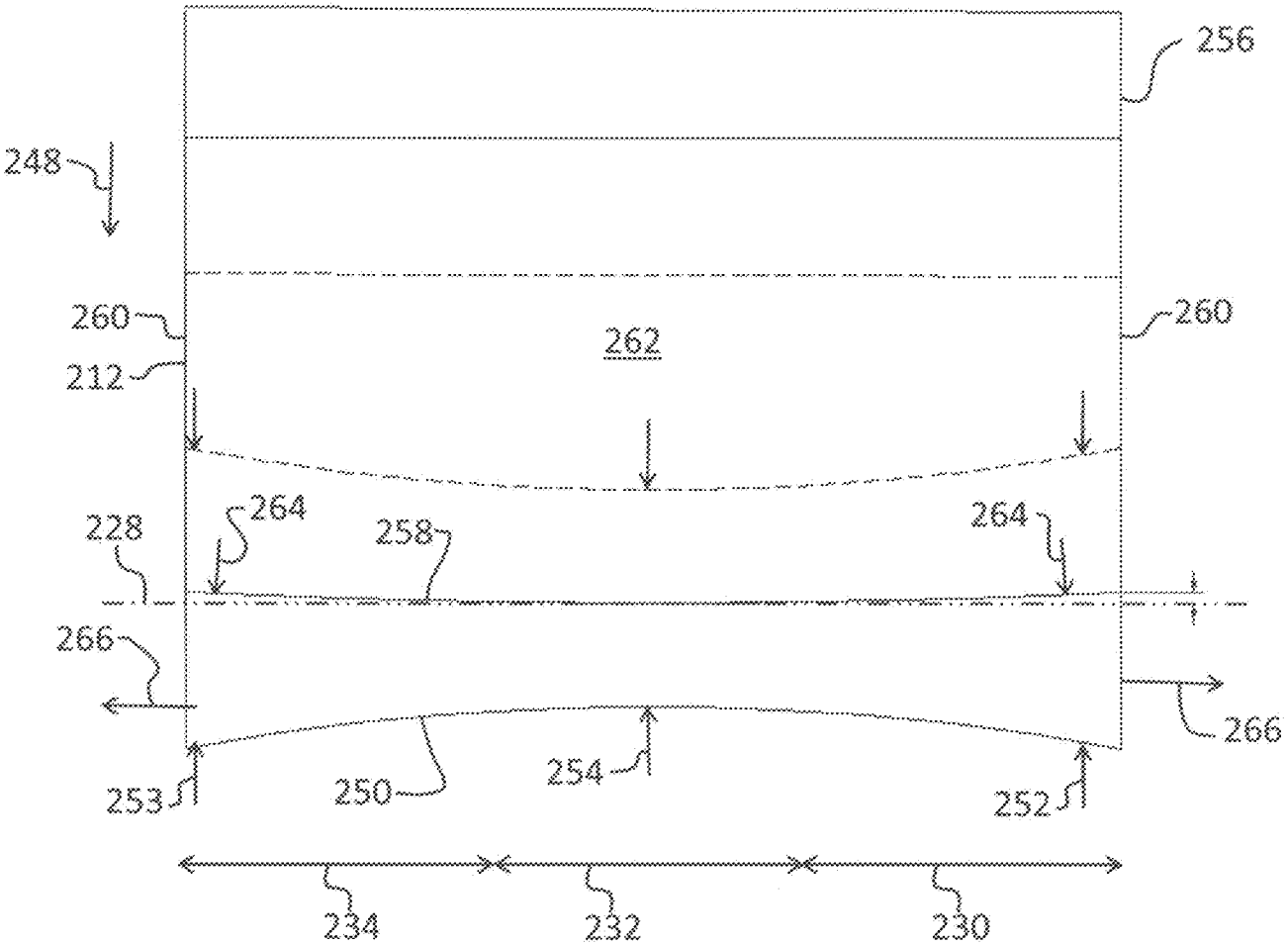
FIG. 4 is a schematic top view of the portion of the example embodiment shown in FIG. 3.

Referring to FIGS. 3 and 4, a concave roller 250 has a larger diameter 252 away from the center of the roller, near the outer edges of the print media, than the diameter 254 near the center of the roller, toward the center of the print media. Stated another way, the concave roller 250 includes a first section 230, a second section 232, and a third section 234. The second section 232 is located between the first section 230 and the third section 234 as viewed along the axis of rotation 228. The roller 250 includes a profile as viewed along the axis of rotation in which the diameter 252 of the roller in the first section 230 and the diameter 253 of the roller in the third section 234 are each greater than the diameter 254 of the roller in the second section 232. In FIG. 3, the print media 212 is shown moving from a straight roller 256. The operation of the concave roller 250 as a spreader is understood at least in part to be the result of the normal entry rule for media guiding rollers. The normal entry rule indicates that the print media approaching a roller will tend to align itself normal, or perpendicular, to the line of contact of the print media to the roller. The contour of concave roller 250 produces a curvature in the line of contact 258 of the approaching print media 212 to the concave roller.

Figure 5:
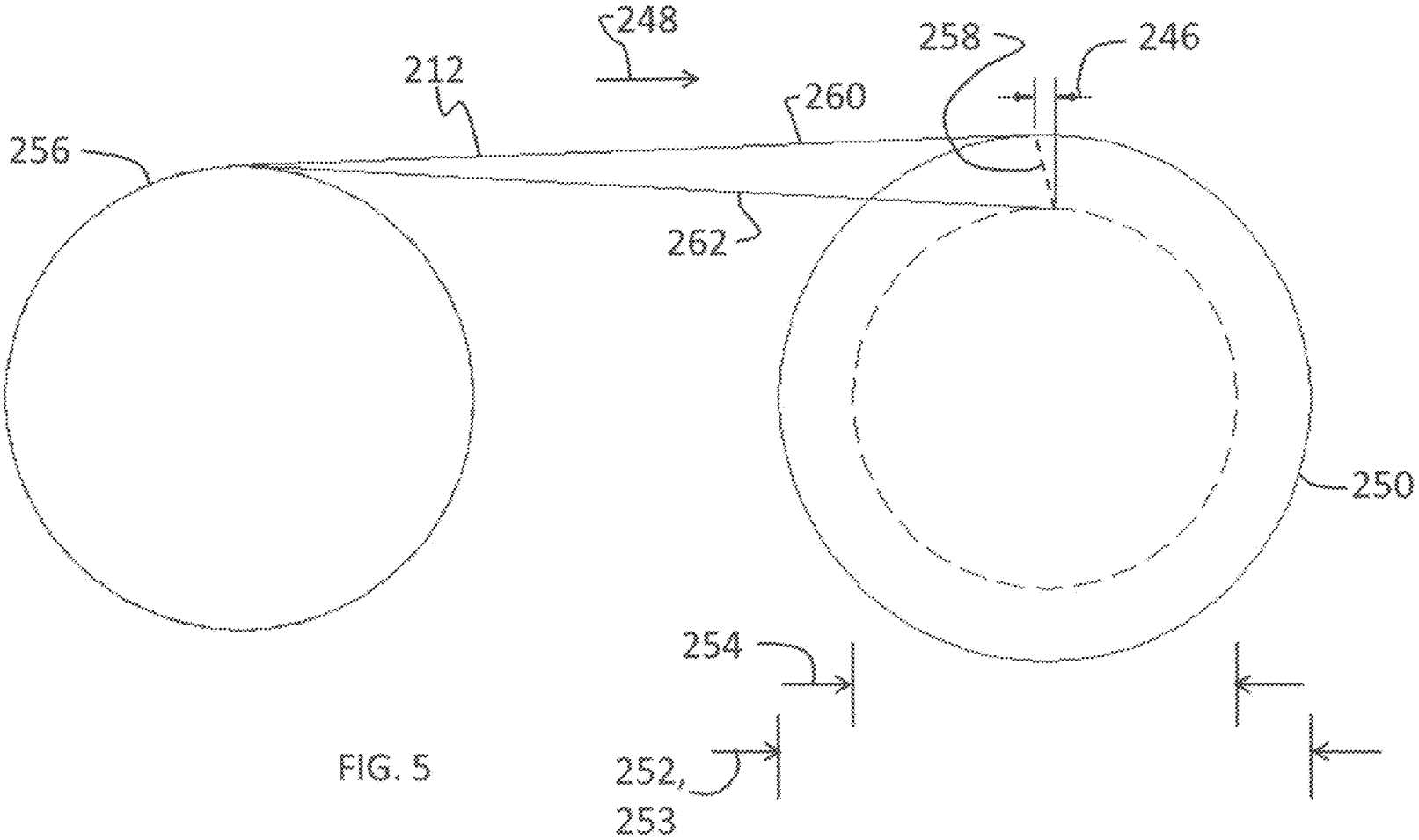
FIG. 5 is a schematic side view of the portion of the example embodiment shown in FIG. 3.

Referring to FIGS. 4 and 5, the outer edges 260 of the print media contact the concave roller in advance of the central portion 262 of the print media. The curvature of the line of contact 258 near the edges of the print media causes the normals 264 to the contact line to flare outward near the outer edges 260 of the print media 212. The normal entry rule therefore indicates that the edges of the print media will tend to migrate away from the center, spreading the print media as indicated by arrows 266. The amount of spreading that can be achieved relative to the initial width of the print media by a concave roller of other spreader is commonly called the spreading factor of the roller or other spreader.

Figure 6:
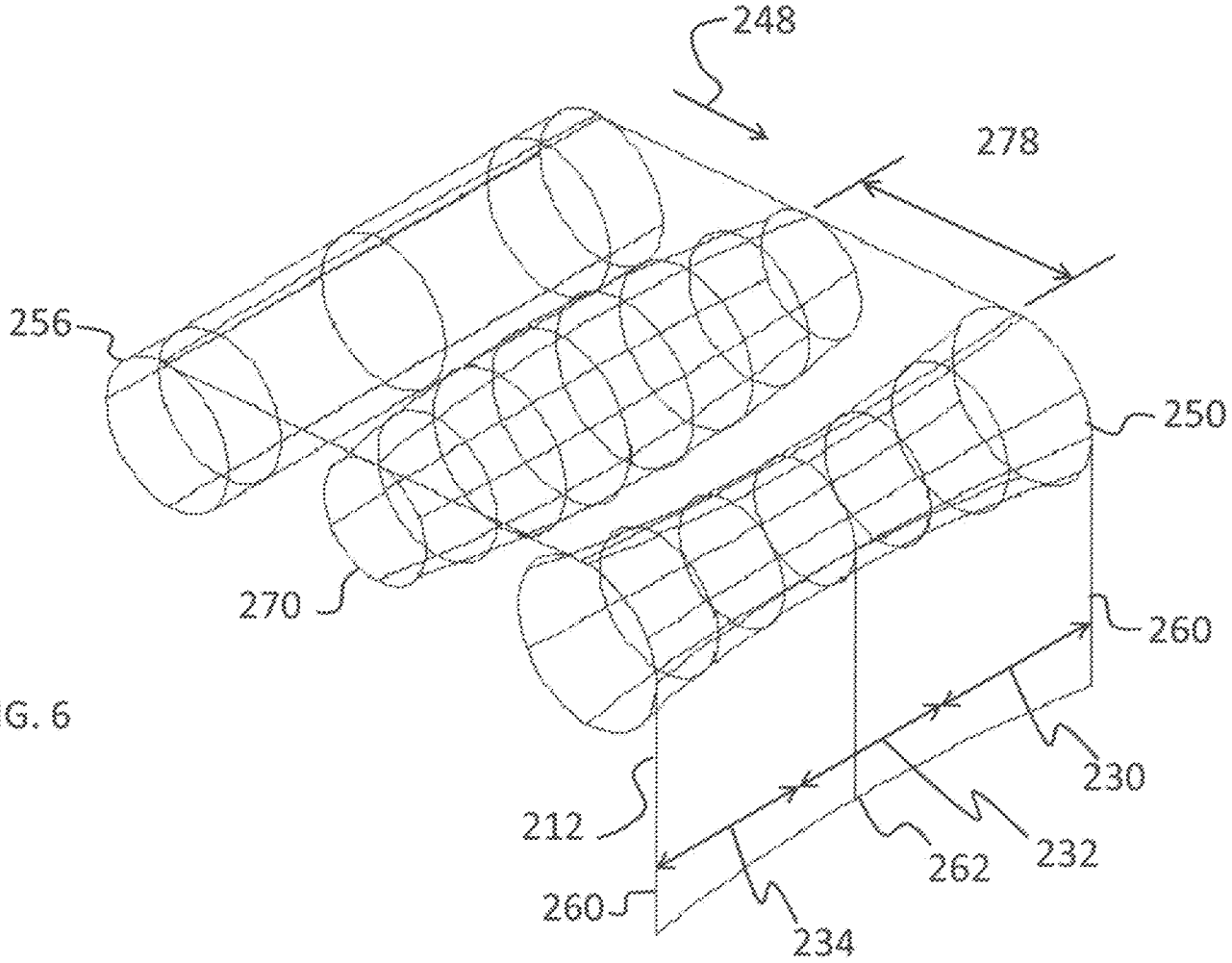
FIG. 6 is a schematic perspective view of an example embodiment of the present invention.
Figure 7:
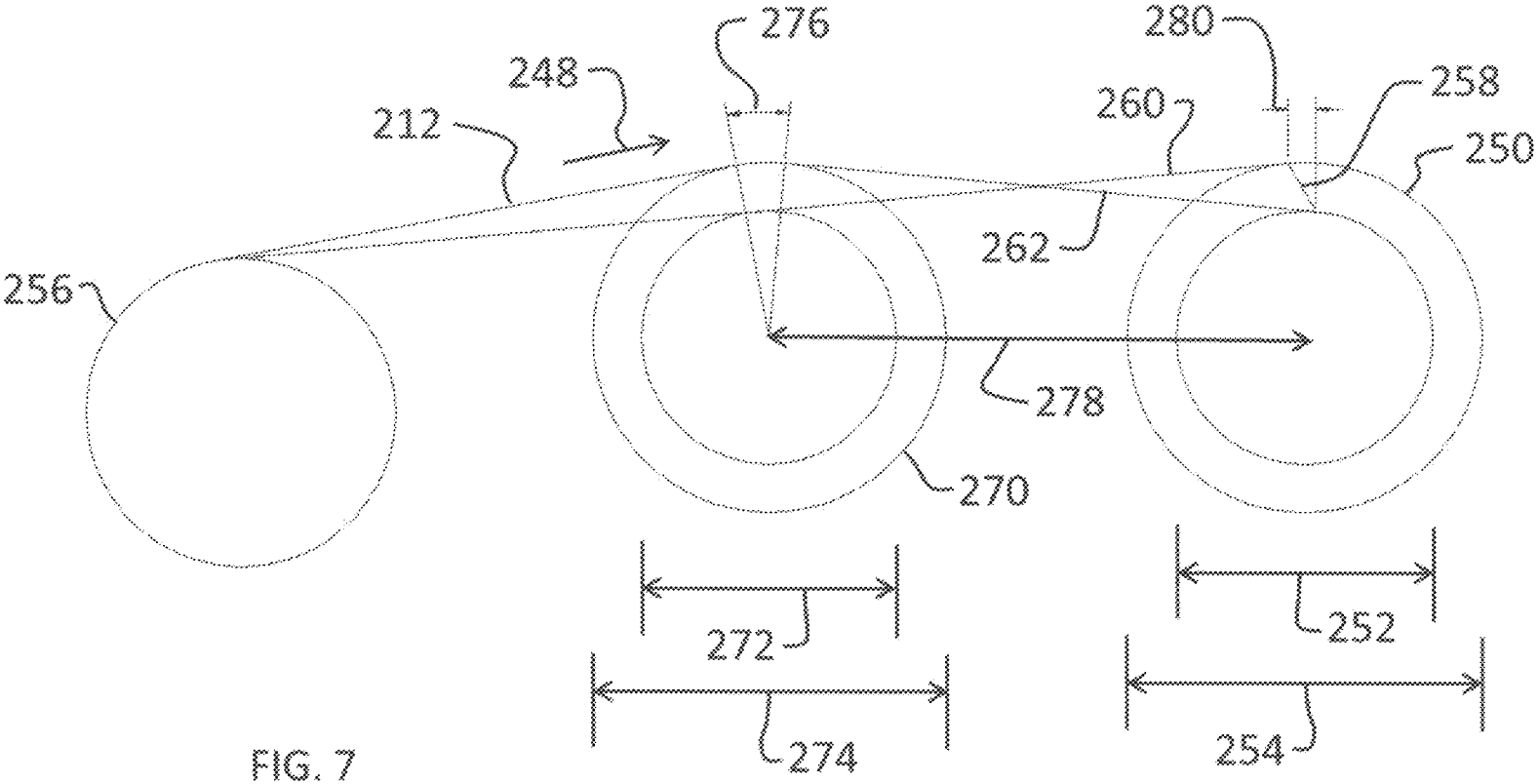
FIG. 7 is a schematic side view of the example embodiment shown in FIG. 6.
Figure 8:
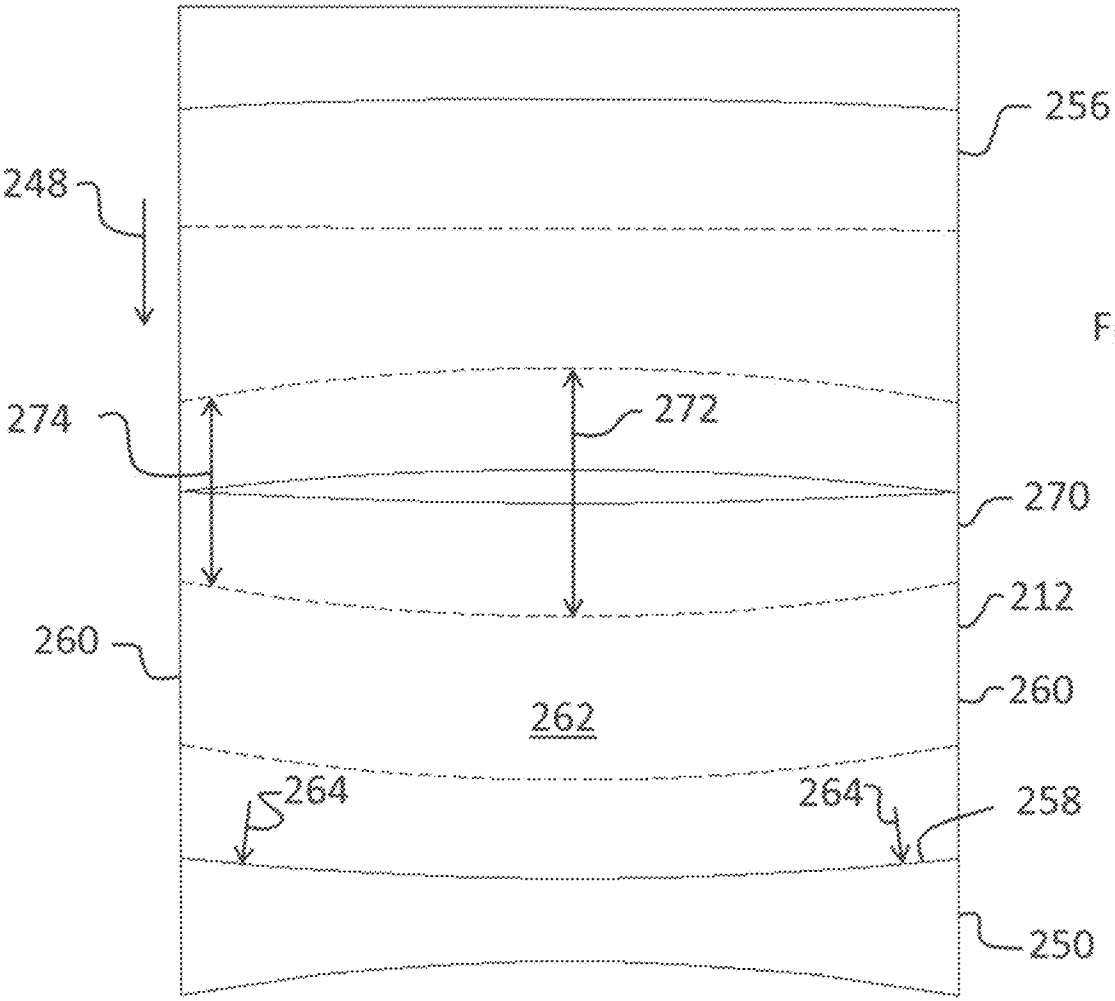
FIG. 8 is a schematic top view of the example embodiment shown in FIG. 6.

The present invention enhances the spreading factor of the concave roller 250 by placing a web guide, for example, a convex, or barrel shaped, roller 270 upstream of the concave roller, as shown in FIGS. 6-8. The convex roller 270 has a larger diameter 272 near the center of the roller relative to the diameter 274 of the roller away from the central portion of the roller. Stated another way, the web guide (convex roller 270 in FIGS. 6-8) includes a first section, a second section, and a third section with the second section being located between the first section and the second section. The diameter of the web guide (convex roller 270 in FIGS. 6-8) is larger in the second section than in the first or the third sections such that the contact surface of the web guide (convex roller 270 in FIGS. 6-8) with the print media forms an arcuate surface with the arcuate surface including a peak located in the second section of the web guide. The peak is directed toward the print media. The first, second, and third sections of the web guide (convex roller 270 in FIGS. 6-8) correspond with the first, second, and third sections of the concave roller 250.

In this configuration, the web guide alters the contour of the print media 212 in the crosstrack direction upstream of the concave roller 250. As a concave roller 250 is known to be a spreading roller, one would expect that a convex roller 270, whose contour is opposite that of the concave roller, would cause the edges of the print media 212 to migrate toward the center of the roller. This would cause the print media to bunch up near the center of the print media, and thereby increase the potential for fluting. It is known however that when there is slip between the print media and the barrel shaped roller, such as when there is only a small amount of wrap of the print media around the barrel shaped roller, a barrel shaped roller can serve as spreading roller.

As shown in FIGS. 6-8, the invention utilizes both a convex roller 270 and a concave roller 250 in combination to provide more spreading than can be achieved separately by the two rollers. It does so by placing the convex roller 270 a short distance 278 upstream of the convex roller, and on the same side of the print media. The print media 212 leaving the convex roller is crowned in the middle or central portion 262 of the web or print media, to match the contour of the convex roller, also called a barrel shaped roller. Crowning the profile of the print media 212 in this manner causes the profile of the contact line 258 of the print media with the downstream concave roller 250 to be altered. The contact line of the print media to the concave roller 250 at the outer edges 262 of the print media 212 is advanced by a greater distance 280 with respect to the contact line in the central portion 260 of the print media when compared to the advance distance 246 of the contact line at the outer edges with respect to the contact line 258 in the central portion 262 of the print media for the prior art system shown in FIG. 4. The contact line 258 has increasing curvature, best seen in FIG. 8, when compared to the contact line with the concave roller downstream of a straight roller shown in FIG. 4. The upstream convex roller by producing a crowned profile to the print media produces greater curvature to the contact line 258 and therefore more divergence of the normals 264 to the contact line 258. As a result the spreading factor is increased.

To avoid the potential of the convex roller 270 inducing fluting before the print media arrives that the concave roller 250, the wrap angle 276 around the convex roller 270 is reduced as much as is permitted. Preferably, the wrap angle 276 is less than or equal to 20°, and more preferably the warp angle around the convex roller is less than or equal to 5°. In this example embodiment, there is essentially no wrap around the convex roller at the outer edges 260 of the print media. The print media therefore travels along essentially a straight path from the straight roller 256 that is upstream of the convex roller past the convex roller to the concave roller 250. This minimal wrap allows the print media to slip as it passes over the convex roller, reducing the tendency of the convex roller to bunch the print media toward the center of the convex roller.

Figure 9A:
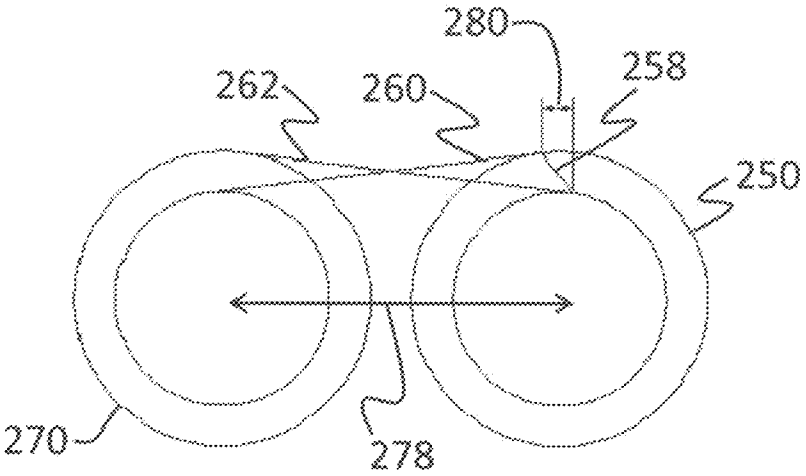
FIGS. 9A and 9B are schematic side views of other example embodiments of the present invention.
Figure 9B:
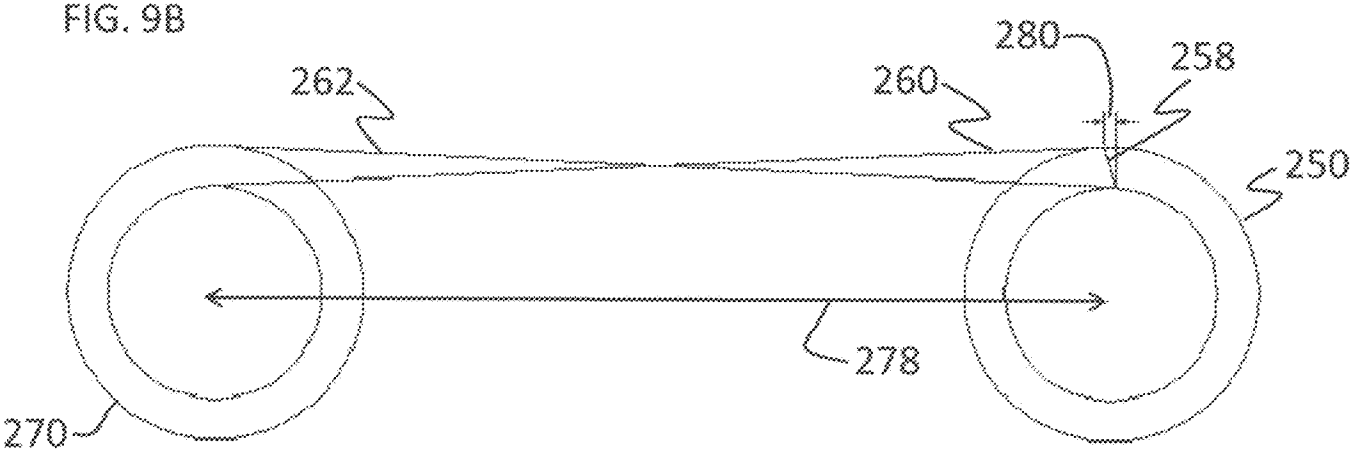

The enhancement of the spreading factor depends on the spacing between the convex roller and the concave roller. Referring to FIGS. 9A and 9B, side views of the span between a convex roller 270 and a concave roller 250 for two different distances 278 between the two rollers are shown. For both the small spacing shown in FIG. 9A and the larger spacing shown in FIG. 9B, the contact line 259 of the print media on the concave roller is curved with the outer edges of the print media contacting the concave roller in advance of the central region of the print media; the advance distance is denoted by 280. As indicated, the advance distance 280 is larger when the distance 278 between the rollers is smaller, in FIG. 9A, when compared to the advance distance 280 when the distance 278 between rollers is larger in FIG. 9B. The increase in the advance distance causes the spreading factor to be larger for smaller distances between the convex roller and the concave roller. Preferably the distance 278 between the convex roller and the concave roller is less than five times the larger outer edge diameter of the concave roller. More preferably the distance 278 between the convex roller and the concave roller is less than 3 times the larger outer edge diameter of the concave roller.

Figure 10:
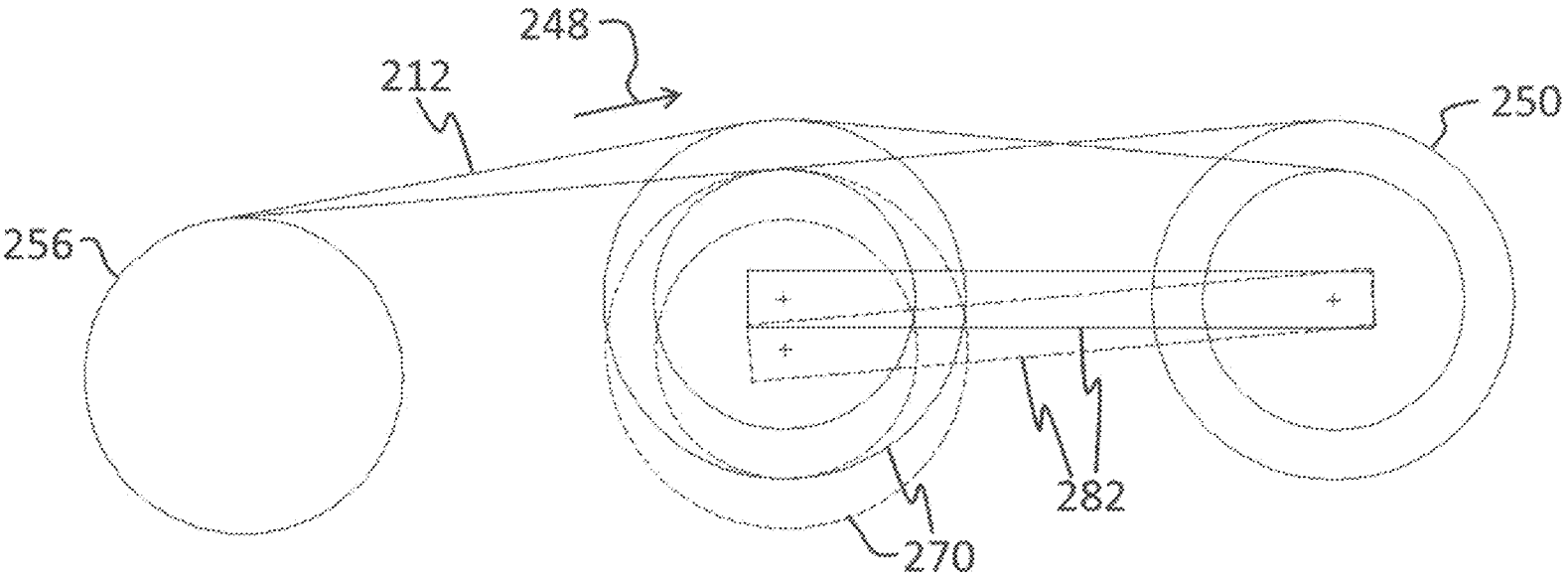
FIG. 10 is a schematic side view of another example embodiment of the present invention.

As different print media have different spreader requirements, such as the need for spreading to avoid excessive fluting and tolerance for spreading to avoid damaging the print media, some embodiments allow the engagement of the convex roller between the concave roller and the upstream straight roller to be varied. FIG. 10 shows an embodiment in which the convex roller 270 is mounted on a pivot arm 282 that can rotate around the axis of the concave roller 250. Positioning hardware, not shown, can position the convex roller 270 so that the outer edges of the print media are just contacting the convex roller to provide more spreading (the convex roller 270 and arm 282 shown with solid lines). For less spreading, the convex roller 270 can be pivoted away from contact with the print media (the convex roller 270 and arm 282 shown in dashed lines). For intermediate amounts of spreading the convex roller can be positioned between the fully engaged and the unengaged positions.

Figure 11:
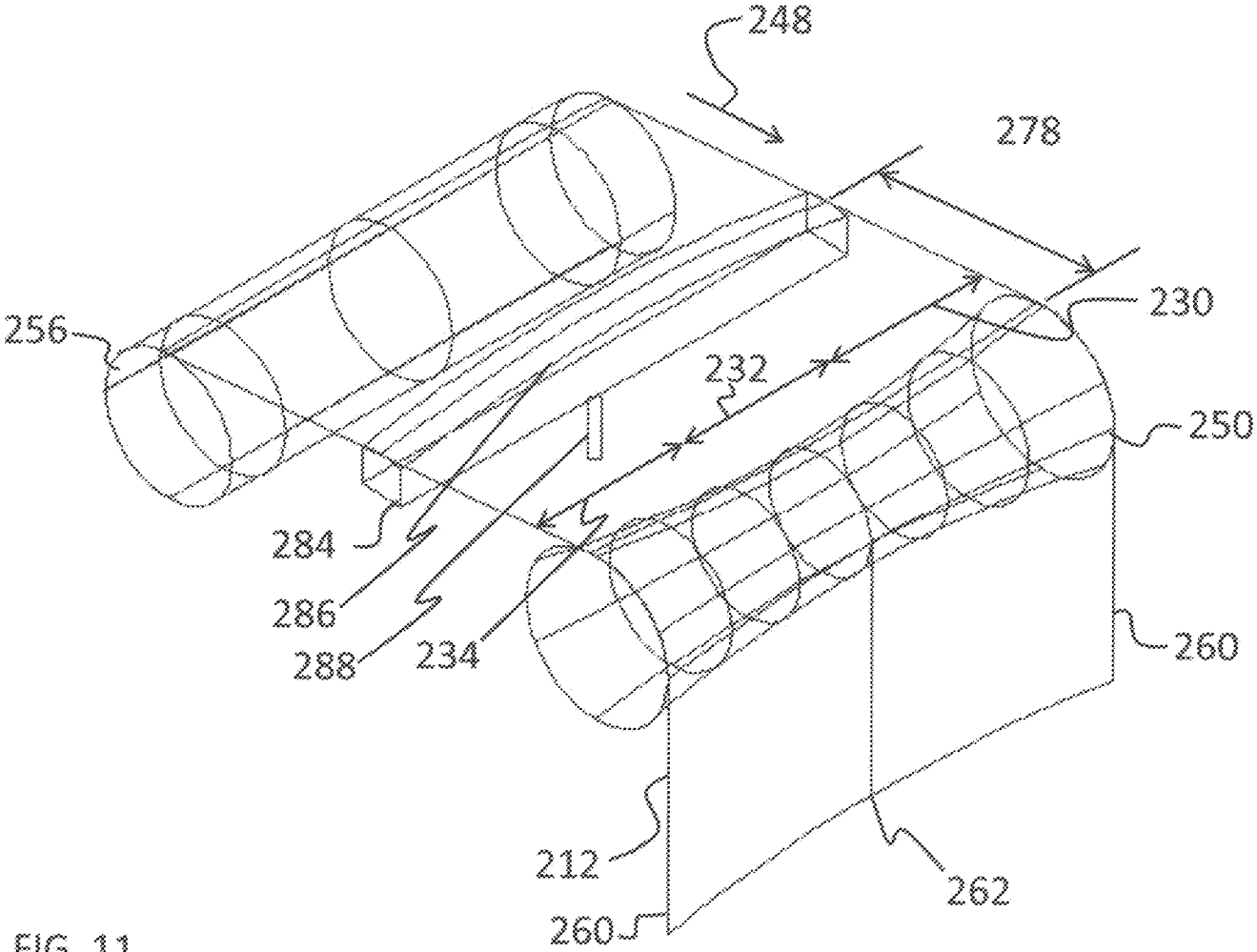
FIG. 11 is a schematic perspective view of another example embodiment of the present invention.

Referring to FIG. 11, in another example embodiment of the invention, the web guide includes a non-rotating edge guide 284, instead of the convex roller 270, positioned upstream of the concave roller 250. The web guide (non-rotating edge guide 284 in FIG. 11) has an arcuate surface including a first section, a second section, and a third section with the second section being located between the first section and the third section. The arcuate surface includes a peak located in the second section. The first section, the second section, and the third section of the web guide (non-rotating edge guide 284) correspond to the first section, the second section, and the third section of the roller 250 such that the contour of the arcuate surface causes the print media, after leaving the web guide, to contact the first section and the third section of the roller prior to contacting the second section of the roller. Crowning the profile of the print media 212 in this manner causes the profile of the contact line 258 of the print media with the downstream concave roller 250 to be altered. The contact line of the print media to the concave roller 250 at the outer edges 262 of the print media 212 is advanced by a greater distance 280 with respect to the contact line in the central portion 260 of the print media when compared to the advance distance 246 of the contact line at the outer edges with respect to the contact line 258 in the central portion 262 of the print media for the prior art system shown in FIG. 4.

As was shown in FIG. 8, the contact line 258 has increasing curvature, when compared to the contact line with the concave roller downstream of a straight roller shown in FIG. 4. The arcuate surface 286 of the web guide 284 by producing a crowned profile to the print media produces greater curvature to the contact line 258 and therefore more divergence of the normals 264 to the contact line 258. As a result the spreading factor is increased. In some embodiments, the arcuate surface 286 of the web guide 284 includes a plurality of holes not shown through which air can be blown to float the print media off the surface of the web guide thereby forming an air bearing to reduce friction between the web guide and the print media. The contours of both the web guide and of the concave roller are both shown as having a single continuous curvature, but the contours are not limited to such contours.

An actuator 288 can be used to adjust the position of the web guide to enable the wrap of the print media around the web guide to be adjustable. With the web guide retracted the spreading of the print media by the system is only that provided by the concave roller. As the web guide is moved into increasing contact with the print media, the print media is increasing crowned by the arcuate surface of the web guide, thereby increasing the curvature of the line of contact with the concave roller and increasing the spreading factor of the print media.

The invention has been described in detail with particular reference to certain preferred embodiments thereof, but it will be understood that variations and modifications can be effected within the scope of the invention.

PARTS LIST

100 In-Track Direction
102 Crosstrack Direction
104 Flute
106 Flute
108 Roller
110 Roller
200 Printing System
202 Module
204 Module
206 Line Head
208 Dryer
210 Quality Control Sensor
212 Print Media
214 Feed Direction
216 Turnover Module
228 Axis of Rotation
230 First Region
232 Second Region
234 Third Region
246 Advance distance
248 Arrow
250 Concave Roller
252 Diameter
253 Diameter
254 Diameter
256 Straight Roller
258 Contact Line
260 Outer Edges
262 Central Portion
264 Normal
266 Arrow
270 Convex Roller
272 Diameter
274 Diameter
276 Wrap Angle
278 Distance
280 Advance Distance
282 Arm
284 Web Guide
286 Arcuate Surface
288 Actuator

The invention claimed is:

1. An apparatus for moving a continuous web of print media comprising:

a web guide having an arcuate surface including a first section, a second section, and a third section, the second section being located between the first section and the third section, the arcuate surface including a peak located in the second section;

a roller having an axis of rotation and a diameter, the roller including a first section, a second section, and a third section, the second section being located between the first section and the third section as viewed along the axis of rotation, the roller including a profile as viewed along the axis of rotation in which the diameter of the roller in the first section and the diameter of the roller in the third section are each greater than the diameter of the roller in the second section, the web guide being positioned along a media travel path immediately upstream relative to the roller, the first section, the second section, and the third section of the web guide corresponding to the first section, the second section, and the third section of the roller such that the contour of the arcuate surface causes the print media, after leaving the web guide, to contact the first section and the third section of the roller prior to contacting the second section of the roller;

wherein the web guide is a convex roller; and the convex roller includes a wrap angle, wherein the wrap angle is less than or equal to 20°.

2. The apparatus of claim 1, the web guide and the roller being spaced apart from each other by a distance of less than or equal to 5 times the diameter of the second section of the roller.

3. The apparatus of claim 1, wherein the web guide and the roller are positioned relative to each other such that both of the web guide and the roller contact the same side of the print media.

4. The apparatus of claim 1, wherein the second section of the web guide and the second section of the roller are centered relative to each other and the print media.

5. The apparatus of claim 4, wherein the web guide and the roller both include a contour of continuous curvature.

6. The apparatus of claim 1, wherein the web guide and the roller both include a contour of continuous curvature.

7. The apparatus of claim 1, wherein the position of the web guide is adjustable to adjust a wrap angle of the print media around the web guide.

8. An apparatus for moving a continuous web of print media comprising:

a web guide having an arcuate surface including a first section, a second section, and a third section, the second section being located between the first section and the third section, the arcuate surface including a peak located in the second section;

a roller having an axis of rotation and a diameter, the roller including a first section, a second section, and a third section, the second section being located between the first section and the third section as viewed along the axis of rotation, the roller including a profile as viewed along the axis of rotation in which the diameter of the roller in the first section and the diameter of the roller in the third section are each greater than the diameter of the roller in the second section, the web guide being positioned along a media travel path immediately upstream relative to the roller, the first section, the second section, and the third section of the web guide corresponding to the first section, the second section, and the third section of the roller such that the contour of the arcuate surface causes the print media, after leaving the web guide, to contact the first section and the third section of the roller prior to contacting the second section of the roller;

wherein the web guide is a convex roller; and the convex roller includes a wrap angle, wherein the wrap angle is less than or equal to 5°.

* * * * *